US005465781A

United States Patent [19]

DeGregoria

[11] Patent Number: 5,465,781

[45] Date of Patent: Nov. 14, 1995

[54] ELASTOMER BED

[75] Inventor: Anthony J. DeGregoria, Madison, Wis.

[73] Assignee: ElasTek, Inc., Madison, Wis.

[21] Appl. No.: 226,479

[22] Filed: Apr. 12, 1994

Related U.S. Application Data

[62] Division of Ser. No. 968,341, Oct. 29, 1992, Pat. No. 5,339,653.

[51] Int. Cl.[6] ..... F23L 15/02

[52] U.S. Cl. ..... 165/8; 165/6; 165/104.11

[58] Field of Search ..... 165/4, 8, 10, 54, 165/909; 62/56, 467

[56] References Cited

U.S. PATENT DOCUMENTS

| | | | |
|---|---|---|---|
| Re. 26,560 | 4/1969 | Meredith | 261/30 |
| 2,610,038 | 9/1952 | Phillips | 128/201.13 |
| 2,931,189 | 4/1960 | Sigworth | 62/172 X |
| 3,036,444 | 5/1962 | Cochran | 62/467 |
| 3,326,214 | 6/1967 | McCoy | 128/201.13 |
| 3,599,443 | 8/1971 | Paine et al. | 62/467 |
| 3,747,598 | 7/1973 | Cowans | 128/142 |
| 3,814,094 | 6/1974 | De Angelis et al. | 128/212 |
| 3,920,009 | 11/1975 | Olsen | 128/140 R |
| 4,054,980 | 10/1977 | Roma | 29/157.3 R |
| 4,069,028 | 1/1978 | Brown | 62/3 |
| 4,124,478 | 11/1978 | Tsien et al. | 204/255 |
| 4,258,784 | 3/1981 | Perry et al. | 165/166 |
| 4,294,242 | 10/1981 | Cowans | 128/201.13 |
| 4,325,365 | 4/1982 | Barbuto | 128/201.13 |
| 4,327,717 | 5/1982 | Oetjen et al. | 128/201.13 |
| 4,332,135 | 6/1982 | Barclay et al. | 62/3 |
| 4,355,636 | 10/1982 | Oetjen et al. | 128/204.13 |
| 4,411,310 | 10/1983 | Perry et al. | 165/166 |
| 4,432,409 | 2/1984 | Steele | 165/8 |
| 4,512,392 | 4/1985 | van Ee et al. | 165/54 |
| 4,577,678 | 3/1986 | Franenfeld et al. | 165/10 |
| 4,733,718 | 3/1988 | Schikowsky et al. | 165/4 |
| 4,744,414 | 5/1988 | Schon | 165/167 |
| 4,771,770 | 9/1988 | Artemenko et al. | 128/201.13 |
| 4,817,708 | 4/1989 | Ono et al. | 165/54 |
| 4,858,685 | 8/1989 | Szücs et al. | 165/166 |
| 4,875,520 | 10/1989 | Steele et al. | 165/10 |
| 4,955,435 | 9/1990 | Shuster et al. | 165/170 |
| 5,007,114 | 4/1991 | Numano | 2/206 |
| 5,010,594 | 4/1991 | Suzuki et al. | 2/206 |
| 5,033,537 | 7/1991 | Atkin et al. | 165/54 |
| 5,320,096 | 6/1994 | Hans | 128/205.29 |

FOREIGN PATENT DOCUMENTS

| | | |
|---|---|---|
| 1234531 | 3/1965 | Germany . |
| 1360064 | 7/1974 | United Kingdom . |
| 2082921 | 8/1980 | United Kingdom . |

OTHER PUBLICATIONS

*Cryogenics*, Pratt et al., vol. 17 (1977) pp. 689–693.

*J. Appl. Phys.*, Brown, vol. 47 (1976) pp. 3673–3680.

*Adv. Cryogenic Eng.*, A. J. DeGregoria et al., vol. 37, part B, (1992) pp. 875–882.

*The Physics of Rubber Elasticity*, Treloar, Oxford University Press (1958) pp. 38–43.

*Primary Examiner*—John Rivell

*Assistant Examiner*—Christopher Atkinson

*Attorney, Agent, or Firm*—Stroud, Stroud, Willink, Thompson & Howard

[57] ABSTRACT

A high performance, low cost, regenerator/heat exchanger matrix or bed. The bed consists of numerous stretched elastomer sheets separated by spacers and stacked. The resulting matrix is of the parallel plate type with high porosity, and narrow, uniform, unobstructed channels. The bed is ideal for near room temperature regenerator applications. The bed may also be used to pump heat or refrigerate, when fitted with a mechanism which allows the stretch of the elastomer sheets to be rapidly increased and decreased periodically.

18 Claims, 5 Drawing Sheets

ELASTOMER BED

This application is a division of Ser. No. 07/968,341 now U.S. Pat. No. 5,339, 653 filed on Oct. 29, 1992.

TECHNICAL FIELD

This invention relates generally to heat transfer devices, i.e., heat exchangers, refrigerators, air conditioners, ventilators, and heat pumps, and more specifically, to devices utilizing the thermoelastic effect of rubber or similar elastomers and the regenerator principle. The invention is particularly well-suited for near room temperature regenerator applications.

BACKGROUND OF THE INVENTION

Heat pumps and refrigerators depend on conversion of one type of energy into heat energy in order to pump heat from a lower to a higher temperature.

The most commonly used system, the "vapor-compression cycle," relies upon the expansion and compression of a gas and utilizes the principle that, when a gas is compressed adiabatically, its temperature rises, and when it is expanded isenthalpically, its temperature diminishes. Typically, a fluid is employed to absorb heat from the compressed gas while another fluid gives up heat to the expanded gas.

Such mechanical systems dominate the cooling field today. These systems use liquid refrigerants that are typically chlorofluorocarbons. These refrigerants have been generally favored because they are easily volatilized, are inert to chemical reaction with most materials, are virtually odorless, nonflammable, noncorrosive, highly stable and have low toxicity compared to alternatives.

However, since 1974, chlorofluorocarbons have been the subject of environmental concern because of their ozone-destructive properties, culminating in an international treaty in 1989, the Montreal Protocol on Substances that Deplete the Ozone Layer, that established global limits on the production and use of chlorofluorocarbons. Under the United States Clean Air Act, chlorofluorocarbons are to be phased out by 1996. No estimate of the global cost of replacing chlorofluorocarbons technologies has been made, but it is estimated that in the United States alone, equipment based on these refrigerants is worth about $135 billion, equipment which must be modified or replaced. Thus, there is a need for new methods of heat transfer, refrigeration and heat exchange.

Furthermore, simple ventilation applications are also in need of energy efficient heat recovery systems that provide high quality indoor air. In recent times, a conflict exists between energy conservation measures and health factors arising from poor indoor air quality due to such conservation measures.

Alternative approaches to heat pumping, refrigeration, and the like are known, though none have approached the widespread use, efficiency and practical design of the vapor-compression systems. One such approach utilizes the magnetocaloric effect. Magnetocaloric systems utilize changes in magnetization to effect heat changes; certain magnetic materials warm upon magnetization and cool upon demagnetization. Various prototypes and models have been demonstrated. See, e.g., Pratt et al., *Cryogenics,* vol. 17 (1977) p. 689; Brown, *J. Appl. Phys.,* vol. 47 (1976).

More recently, test results have been reported for an active magnetic refrigerator that uses the regenerator principle See, e.g., U.S. Pat. No. 4,332,135 issued to Barclay et al.; A. J. DeGregoria et al., *Adv. Cryogenic Eng.* vol. 37, part B (1992) pp. 875–882. The regenerator principle involves heat recovery when a fluid (referred to as a shuttle fluid) is reciprocally exchanged between two reservoirs of different temperature, i.e., alternating flow by a hotter or colder fluid with some mechanism, such as the use of displacers, for effecting this reciprocating fluid flow through the system. The two-part regenerator cycle consists of flow of the fluid from the cold to the hot reservoir through a bed of porous heat transfer material, followed by flow of the fluid from the hot to the cold reservoir through the bed.

Where the heat capacity of the bed is very large compared to the heat capacity of the shuttle fluid, a temperature profile is established in the regenerator. The shuttle fluid is the total fluid mass that flows in one direction prior to reversal. After many reciprocating flows, the bed material establishes a temperature profile that increases from the side at which the cold fluid enters to the side at which the hot fluid enters. During the flow from cold to hot, the fluid enters at temperature $T_C$, the temperature of the cold heat exchanger. It is warmed by the bed as it passes through the bed, and leaves the bed at a temperature below $T_H$, the temperature of the hot exchanger. During flow from hot to cold, the fluid enters the bed at temperature $T_H$. It is cooled by the bed as it passes through and leaves the bed at a temperature above $T_C$. This difference in temperature of the fluid from entrance to exit from the bed, $\Delta T$, causes heat flow from the hot to cold reservoir. At worst, it is $T_H-T_C$, if there were no regenerator present. The ratio of $\Delta T$ to $(T_H-T_C)$ is referred to as the regenerator ineffectiveness. Over the cycle, the bed receives no net heat. It acts as an intermediate heat reservoir, absorbing heat from the warm gas and rejecting it to the cool gas.

Passive regenerative devices, for example, in the form of rotary air-to-air heat exchangers, have been described. U.S. Pat. No. 4,432,409 issued to Steele, describes a matrix (porous bed) formed of strips of plastic wound onto a hub with suitable spacing to form gas passages. Plastic is employed for its high heat capacity. U.S. Pat. No. 4,875,520 issued to Steele et al. describes a similar wheel arrangement in which a desiccant is applied to the plastic to make an enthalpy exchanger, i.e., a heat exchanger designed to remove both sensible heat and latent heat. Enthalpy exchangers offer significant advantages in many heat, ventilation and air conditioning (HVAC) applications since exchange of humidity as well as exchange of heat from indoors to outdoors can be minimized. In the Steele et al. device, a solvent is used to dissolve the outer layer of the plastic sheet before adding the desiccant particles. The desiccant particles are then added, partially embedding in the plastic.

In an active magnetic regenerator refrigerator, the porous bed is a magnetic material sandwiched between the two heat exchangers. Some mechanism exists for magnetizing and demagnetizing the bed. The cycle then consists of (i) bed magnetization, warming the magnetic material and bed fluid by the magnetocaloric effect; (ii) cold to hot fluid flow through the bed, transferring heat to the hot heat exchanger; (iii) bed demagnetization, cooling the magnetic material and fluid; (iv) and hot to cold fluid flow through the bed, absorbing heat at the cold heat exchanger. That is, the active magnetic regenerator magnetizes and warms the bed prior to fluid flow from cold to hot, then demagnetizing cools the bed prior to flow from hot to cold.

The single temperature profile of the bed in a passive regenerator now becomes a double profile for the active regenerator, one for the magnetized bed and one for the demagnetized bed. The difference between the two at any location is the adiabatic temperature change of the magnetic material in going through the field change. If the adiabatic temperature change is large enough, the fluid emerging from the cold end of the bed can have a temperature lower than $T_C$, the temperature of the cold reservoir, resulting in net cooling, rather than a heat leak. According to the laws of Thermodynamics, of course, work must be done in the process since heat is flowing from a cold to a hot reservoir. In the case of a moving magnet, the work is performed by a drive.

Another principle that can be utilized in heat transfer/recovery systems is the thermoelastic effect. Certain elastomers, e.g., rubber, exhibit a thermoelastic effect in which the elastomer warms upon stretching and cools upon relaxing. Temperature changes as large as 14° C. can occur, and for example, air (fluid) can be temperature-affected by forcing the air (fluid) over the elastomer as it is stretched and/or relaxed.

Elastomer refrigeration appears to permit more practical room temperature applications than magnetic refrigeration. In magnetic refrigeration, superconducting magnets are actually required to obtain adiabatic temperature changes large enough to be practical (approximately 8° C. for a 7 Tesla magnetic field). These superconducting magnets require cryogenic refrigeration. Hence, only very large cooling power applications of magnetic refrigeration can be practical at room temperature. No such restriction obtains for elastomer refrigeration.

Some prior art devices utilize the thermoelastic effect; see, for example, U.S. Pat. No. 2,931,189 issued to Sigworth, U.S. Pat. No. 3,036,444 issued to Cochran, and U.S. Pat. No. 3,599,443 issued to Paine et al., all of which describe refrigerators, air conditioners and/or heat pumps using the thermoelastic effect of rubber. None of the disclosed designs, however, uses regeneration, and as a consequence, none of the devices can span a temperature greater than the adiabatic temperature change of the elastomer employed. Most of these designs also exhibit poor heat transfer between the elastomer and the fluid.

Thus, notwithstanding the many known problems with current mechanical systems and the practical design problems of alternative systems, the art has not adequately responded to date with an inexpensive, high performance device that can act both as a heat exchanger for ventilation and a heat pump for air conditioning or heating that utilizes regeneration and allows a high heat transfer. In particular, the art has not produced an elastomer heat exchanger that utilizes regeneration and allows a high heat transfer between the fluid and the elastomer for near room temperature regenerator applications.

SUMMARY OF THE INVENTION

The present invention responds specifically to the long-felt need heretofore unmet by the prior art, and especially with a view to overcoming the environmental concerns with chlorofluorocarbon refrigeration technologies and the inherent inadequacies of alternative refrigeration systems. The system of the present invention provides a high performance, low cost, regenerator/heat exchanger based on the thermoelastic effect. The system has minimal thermal fatigue, if any, due to the thermal cycling that occurs during operation, is easy to clean, and has very low thermal conductivity, reducing conduction of heat from the hot to the cold side of the regenerator and increasing effectiveness.

The system can act both as a heat exchanger for ventilation and a heat pump for air conditioning or heating. When used as a heat pump, efficiencies, comparable to the conventional vapor-compression cycle, are possible. No harmful chlorofluorocarbon gases are utilized. No gases are used at all in the ventilation/heat pump configuration other than air.

The foregoing, and other advantages of the present invention, are realized in one aspect thereof in a heat exchanger bed, which includes layers of elastomeric sheets with spacers between the sheets to define substantially rectangular fluid flow channels therebetween, and locking mechanism for holding the sheets and spacers together in a stack and rigidifying the stack. The bed further includes end plates or end sheets secured at the top and bottom of the stack of thermoelastomeric sheets and spacers. These end plates extend beyond the peripheral edges of the stacked thermoelastomeric sheets and spacers and act as flow controls to ensure that flow is directed through the flow channels.

In another aspect, the invention is a rotatable heat recovery device. The device includes a wheel having a plurality of thermoelastomeric bed modules disposed radially about an axle. The bed modules are constructed as described hereinbefore for the bed. The wheel of the device also includes an eccentricity mechanism for stretching and contracting the thermoelastic sheets in the modules.

In yet another aspect, the invention provides a ventilation system that employs the rotatable heat recovery device. The system includes an intake duct having a flow of incoming outdoor air, an exhaust duct having a flow of outgoing indoor air. The heat recovery wheel is sealed within and interrupts the intake duct and exhaust duct such that when incoming air is directed through one module of the wheel, outgoing air is directed through another module of the wheel.

In a further aspect, the invention provides a method of refrigeration of the type employing an elastomeric element, a regenerator and a heat transfer fluid at temperatures $T_C$ and $T_H$, respectively. The method includes (a) stretching the elastomeric element to increase the average temperature of the element by $\Delta T$; (b) flowing the fluid at a temperature substantially $T_c$ through the element so that the fluid flows out of the element at $T+\Delta T$, (c) contracting the element to decrease the average temperature of the element by $\Delta T$, (d) flowing the fluid through the element at $T_H$ so that the fluid flows out of the element at about $T_C-\Delta T$, and (e) transferring heat from the emerging fluid during step (b) and transferring heat to the merging fluid during step (d) to objects to be temperature affected thereby.

The invention also provides a refrigeration apparatus, which includes (a)a porous matrix including an elastomeric element; (b) a temperature changing mechanism for the porous matrix by stretching or contracting the elastomeric element; (c) a circulator for passing a heat transfer fluid through the porous matrix in one direction when the bed is at one temperature or stretch and for reversing the direction of the flow of fluid through the porous bed when the bed is at a different temperature or stretch; and (d) heat exchangers for receiving the fluid from both directions from the bed and for circulating the fluid through an object to be temperature affected thereby. The refrigerator further includes a plurality of matrices disposed radially about a rotatable wheel. The wheel includes an eccentricity mechanism for eccentrically stretching and contracting the elements of the matrices. The heat exchangers include a hot heat exchanger proximate one side of the wheel and a cold heat exchanger proximate the other side of the wheel.

Other advantages and a fuller appreciation of the specific attributes of this invention will be gained upon an examination of the following drawings, detailed description of preferred embodiments, and appended claims. It is expressly understood that the drawings are for the purpose of illustration and description only, and are not intended as a definition of the limits of the invention.

BRIEF DESCRIPTION OF THE DRAWINGS

The preferred exemplary embodiment of the present invention will hereinafter be described in conjunction with the appended drawing wherein like designations refer to like elements throughout and in which.

DETAILED DESCRIPTION

The present invention relates broadly to coolers, heat exchangers, and heat pumps. More specifically, the present invention relates to devices utilizing a thermoelastic effect in which an elastomer warms upon stretching and cools upon relaxing, and using a regenerator to expand the temperature span possible. The present invention is particularly well suited for near room temperature regenerator applications. Accordingly, the present invention will now be described in detail with respect to such endeavors; however, those skilled in the art will appreciate that such a description of the invention is meant to be exemplary only and should not be viewed as limitative on the full scope thereof.

The present invention is characterized by an ability to act both as a heat exchanger for ventilation and a heat pump for air conditioning or heating having a high heat transfer between fluid and elastomer, and when used as a heat pump, has efficiencies comparable to conventional vapor-compression systems. These attributes are achieved through a novel combination of physical parameters.

As used herein, the term "regenerator" refers to alternate flow of fluid at two different temperatures through a heat transfer medium. It is noted that in HVAC applications a single fluid is used; however, two fluids can be used, that is, the regenerator can be used to transfer heat from one kind of fluid to another. The performance of a regenerator or heat exchanger is measured in terms of heat transfer per unit pressure drop. The geometry of the flow channels through which the fluid flows significantly affects performance. The dimensionless number, $$\alpha = \frac{ST\,Pr^{2/3}}{f}$$

where St is the Stanton number, Pr is the Prandtl number and f is the friction factor, is used as a measure of the heat transfer per unit pressure drop. Kays and London (W. M. Kays and A. L. London, *Compact Heat Exchangers,* McGraw-Hill, N.Y. 1984) list the following α values for different fluid flow channel geometries:

| Channel Geometry | α |
|---|---|
| infinite parallel | 0.386 |
| rectangular 4 to 1 aspect ratio | 0.328 |
| circular | 0.307 |
| square | 0.286 |
| triangular | 0.263 |

It is seen that channels which are formed by two infinite parallel planes have the highest heat transfer per unit pressure drop.

Figure 1:
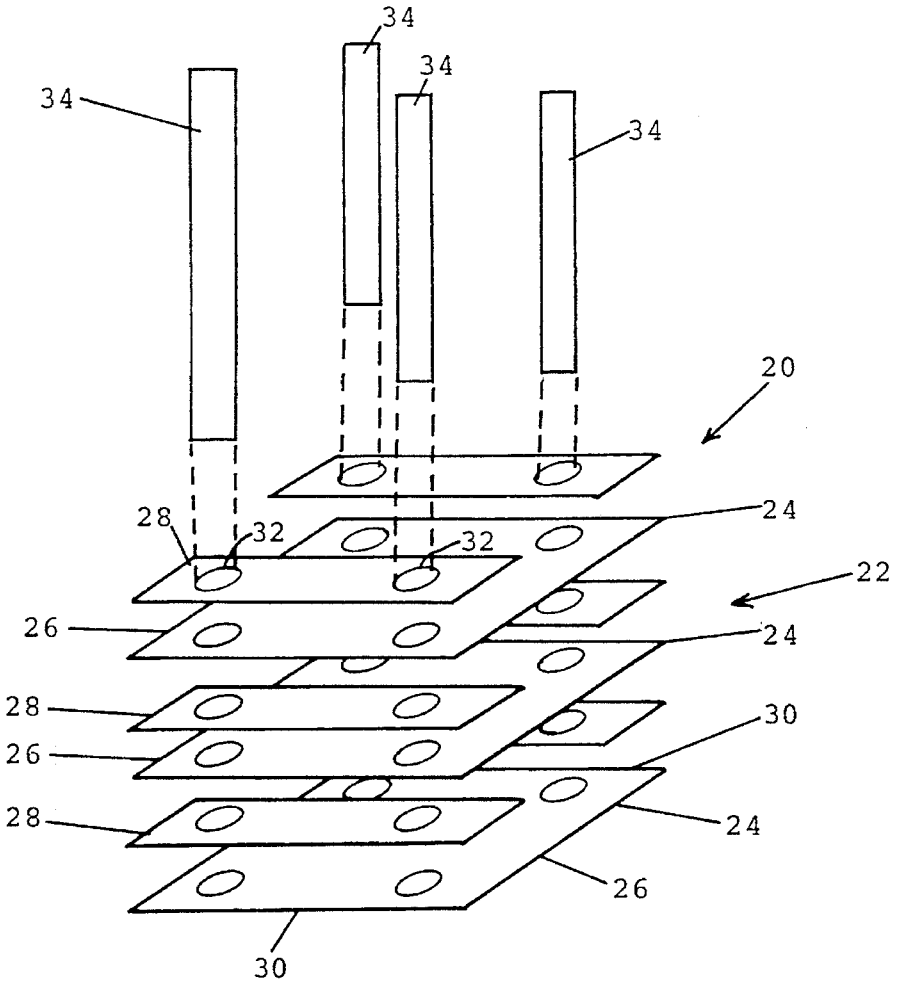
FIG. 1 is an exploded view of the elastomer sheets and spacers in the elastomer regenerator.
Figure 2:
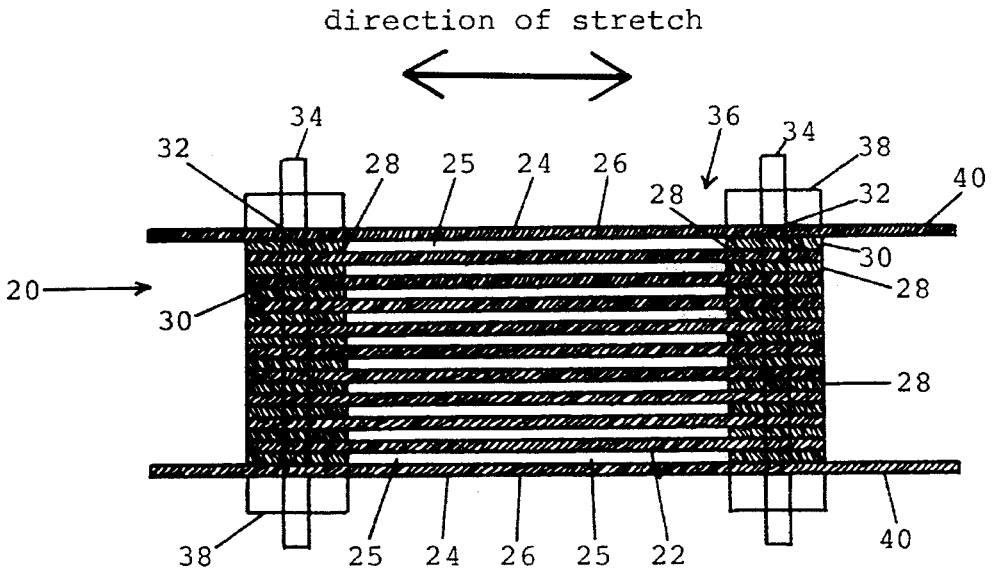
FIG. 2 is an elastomer regenerator module after assembly.

Reference is initially made to FIGS. 1 and 2 depicting an elastomer regenerator/heat exchanger bed according to the present invention and generally designated as 20. The elastomer bed 20 in accordance with the present invention includes a matrix 22 having parallel plates 24 with flow channels 25 in between the plates. The plates 24 are separated by spacers 28 of equal thickness that lay along opposite edges 30 of the plates 24. The plates 24 are layers of stretched elastomer sheets 26. As used herein, the term "spacer" is meant to refer to any thing or device that can separate the plates. For example, a spacer may be a separate shim or sheet or may be a portion of the elastomer sheet that is thicker than the plate proper.

FIG. 1 shows an exploded view of the spacers 28 and the elastomer sheets 26. The spacers 28 are suitably adhered to the elastomer sheets 26. The elastomer sheets 26 and spacers 28 are shown with holes 32 for the insertion of threaded rods 34. In construction, it has been found to be easier to first glue a spacer to a sheet, then punch the holes. Suitable adhesives for the spacers include Superglue™ especially if the spacers are plastic. A masking tape, e.g., Tuck Tape™, New Rochelle, N.Y., was also found to work well. The masking tape was applied to both sides of the elastomer sheet, instead of just one side.

The elastomer is suitably, for example, latex, neoprene, silicone rubber, hycar, or thermoplastic rubbers. Latex rubber, for example, warms as much as about 14° C. upon stretching. Neoprene also warms as much as about 14° C. (See, Trealor, *The Physics of Rubber Elasticity,* Oxford University Press, 1958, and references therein).

If the bed is maintained above the so-called glass transition temperature of the elastomer, then the elastomer bed maintains its shape with temperature. The glass transition temperature is the temperature at which an elastomer goes from rubber-like to the glassy state. The transition for vulcanized rubber occurs between about −55° C. (−67° F.) and −60° C. (−76° F). (See, Trealor, *The Physics of Rubber Elasticity*, Oxford University Press, 1958).

FIG. 2 shows an elastomer bed module 36 with inserted rods 34. Rectangular blocks 38 are provided to add rigidity to the module. Extra large elastomer sheets 40 are used for the outermost sheets. These can be used for flow control, to channel the flow through the flow channels 25 and not around them.

The initial stretch of the elastomer sheets of the module is in the direction of the arrows of the FIG. 2. The stretched elastomer sheets 26 become taught flat plates, separated at precise and equal distances. It has been found that if the initial stretch of the sheets was about two or more times the unstretched length, the sheets were found to be very resistant to flapping even in high air flow.

It should be noted that in the description herein of operation of the elastomer sheet bed, changes in stretch of the elastomer sheets are between higher and lower states of stretch rather than between a stretched and completely relaxed state.

Figure 3:
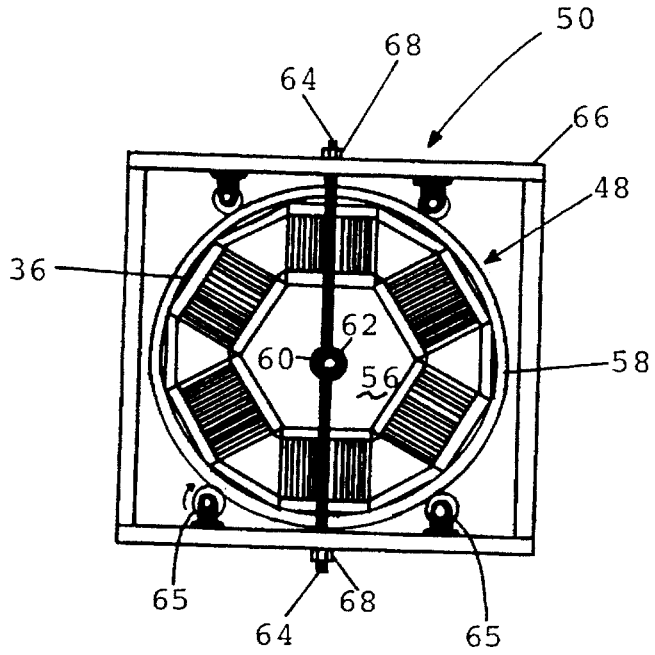
FIG. 3 is a rotary regenerator wheel in accordance with the present invention.
Figure 4:
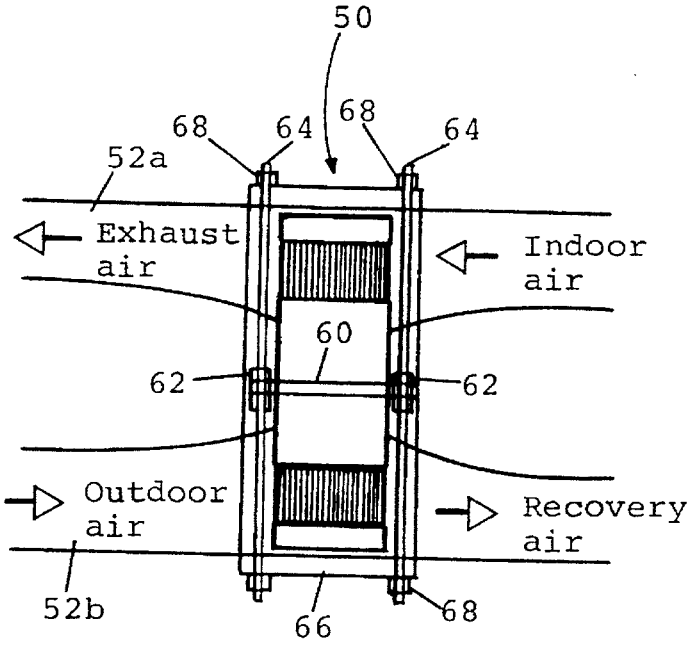
FIG. 4 illustrates the elastomer regenerator modules in a standard ventilating configuration.
Figure 5:
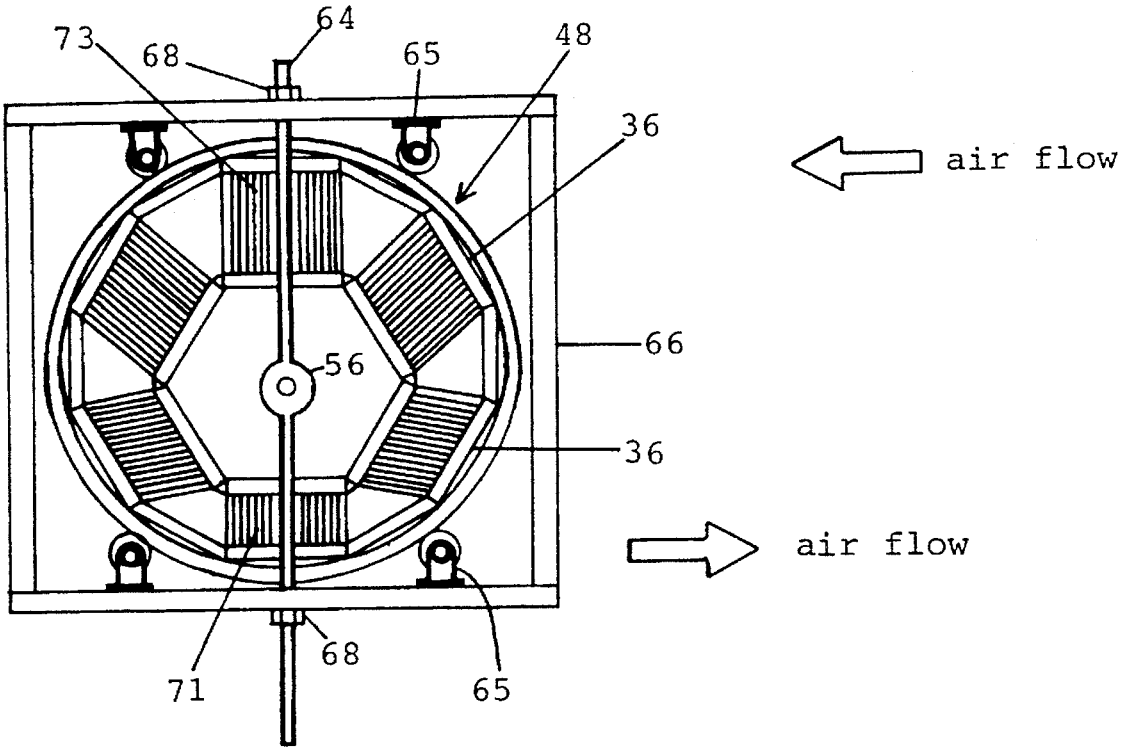
FIG. 5 is the elastomer regenerator wheel in an eccentric mode of rotation.

FIG. 3 shows a heat recovery assembly 50 of six elastomer bed modules 36 of the type illustrated in FIG. 2, placed around a wheel hub 56 to form a wheel 48. The planes of the stretched rubber sheets are along the radial direction of the wheel. Solid hub 56 of the wheel 48 is connected to a rim 58 through the modules 36. The hub 56 rotates about a shaft 60 which is held by two bushings 62. The bushings 62 are attached to rods 64 which attach to a housing 66. The rods 64 are suitably attached to housing 66 by, for example, threadedly attached with nuts 68. By adjusting the nuts 68, the hub 56, as best seen in FIGS. 4 and 5, can be constrained to rotate concentrically or eccentrically with respect to the rim 58. Motorized wheels 65 (motors not shown rotate wheel 48.

In FIG. 4, the wheel regenerator assembly 50 is shown in a ventilation configuration or a passive regenerator mode. The wheel 48 spans two ducts 52*a* and 52*b*. Duct 52*a* carries an exhaust gas (indoor hot air), while duct 52*b* carries the fresh air (outdoor cold air). When a module 36 enters duct 52*a*, heat is absorbed by the module 36 from the hot gas passing through it. As the module 36 rotates, it enters gas duct 52*b*. In this position, the regenerator module 36 transfers the heat to the fresh air stream. The wheel assembly 50 works equally well under the opposite temperature conditions.

FIG. 5 shows the wheel 48 in an eccentric setting. The eccentricity of the wheel 48 is changed by tightened rods 64. Such an eccentricity change of the wheel is also suitably changed by, for example, an electric motor(s) since the wheel may be in an inaccessible location. The sheets 26 of a module 36 warm and cool as they are stretched and relaxed, progressing around the wheel 48. Ducting similar to FIG. 4 forces flow in one direction through the regenerator modules 36 when they are in a region of minimum stretch 71, and in the opposite direction when they are in a region of maximum stretch 73. This converts the passive regenerator into an active regenerator in which heat is pumped from one side of the wheel to the other.

The active regenerator of the present invention has a high efficiency as a heat pump. The coefficient of performance (COP; cooling power divided by the input power) can range from 3 to 6. This is comparable to existing vapor-compression cycles. The inefficiency of blowers (not shown) used in a heat transfer system, which can be large, is not included. When the passive device is used for ventilation, in any case, it can be argued that these losses would be occurring anyway.

Figure 6:
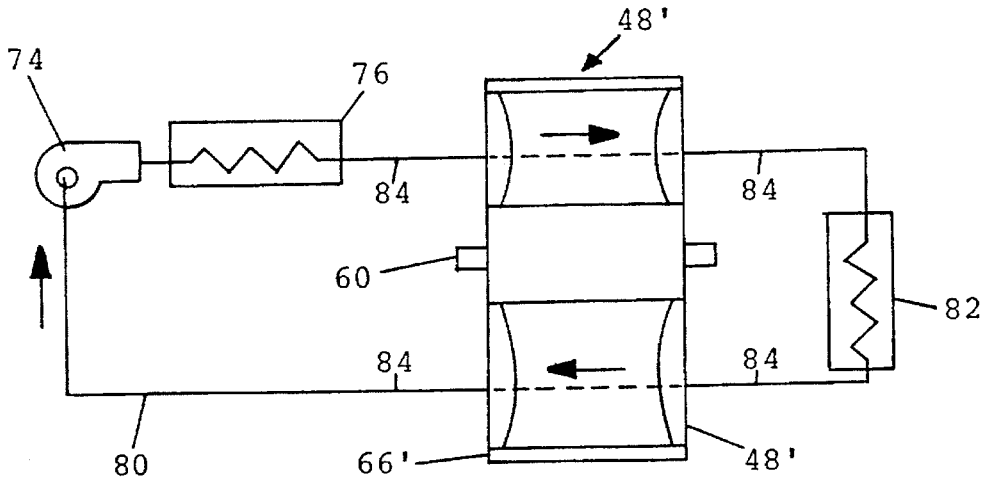
FIG. 6 is a schematic diagram of a sealed version of a rotating elastomer bed used for heat pumping or refrigeration.

FIG. 6 is a schematic illustration of a sealed system using a separate high pressure (several atmospheres or more) fluid 80 such as helium. A circulator 74 forces the fluid 80 through a line or pipe 84 and the fluid 80 first passes through a hot heat exchanger 76 to reject heat to some external sink (not shown). The fluid 80 then passes through the cold (low stretch) side of a wheel 48', then through a cold heat exchanger 82 to absorb heat from an external source (not shown). The fluid 80 then passes back through the hot (high stretch) side of the wheel 48' and back to the circulator 74. The wheel 48' is depicted from its side. A housing 66' surrounds the wheel 48' and connects tightly to the four pipes 84 entering it. Motor(s) (not shown) driving the wheel 48' and circulator 74 can be part of the sealed system. Internally, the sealing of flow will be similar to the wheel in a ventilator/heat pump application. The arrows shown in FIG. 6 indicate the direction of fluid flow.

In this application where the active regenerator of the present invention is used only as a heat pump, sealing is more important to performance. The claim can no longer be made that those losses can be put on the ventilator side of the ledger. Since the system is sealed, it is much easier to obtain good sliding seals. Greases and oils that will not evaporate can be used in conjunction with sliding rubber seals. Leakage from the hot side of the wheel to the cold side, around the bed modules, is generally more detrimental since the temperature span of the device will often be several times the temperature change of the material due to stretching.

Figure 7:
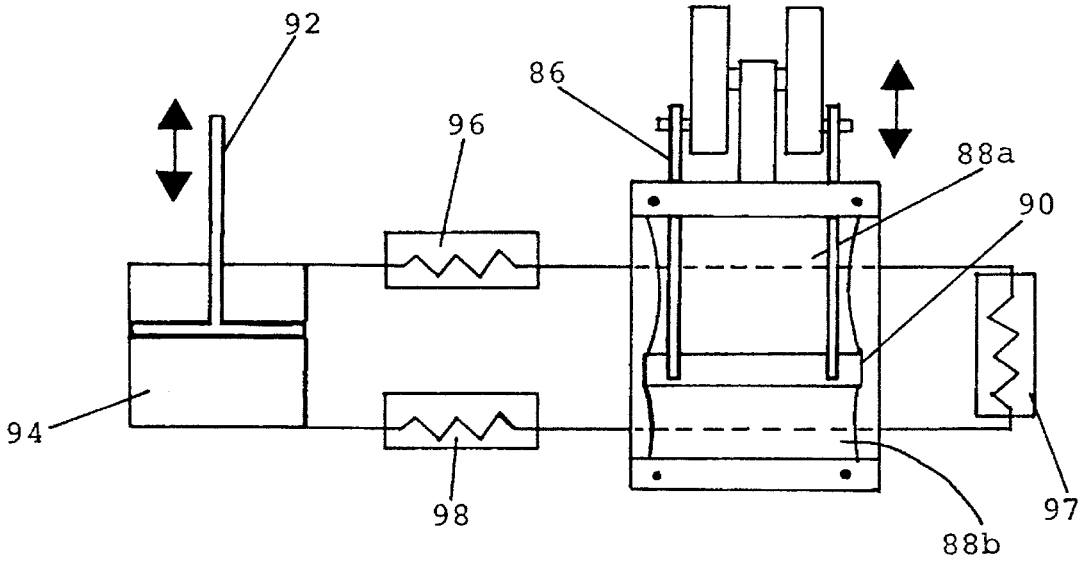
FIG. 7 is a schematic diagram of a sealed version of a reciprocating elastomer bed used for heat pumping or refrigeration.

FIG. 7 schematically illustrates a reciprocating configuration. A reciprocating bed drive 86 moves two beds 88*a* and 88*b* connected at a common end 90. The two beds can be fabricated by stacking elastomer sheets, each with three spacers attached, one at each end and one midway between. A separate displacer drive 92 moves a double acting displacer 94. As the bed drive 86 moves up, the upper bed 88*a* relaxes and the lower bed 88*b* stretches. As the drive 86 moves down, the opposite occurs. A complete cycle is as follows: With the displacer 94 stationary, the bed drive 86 moves up, relaxing and cooling the upper bed 88*a* and stretching and warming the lower bed 88*b*. The bed drive 86 stops. The displacer drive 92 moves the displacer 94 up, forcing flow through one of two hot heat exchangers 96, through the upper bed 88*a*, through the cold heat exchanger 97, through the lower bed 88*b*, through the other hot heat exchanger 98, and finally to the opposite side of the displacer 94. The displacer 94 stops. The bed drive 86 moves downward, stretching and warming the upper bed 88*a*, relaxing and cooling the lower bed 88*b*. The bed drive 86 stops. The displacer drive 92 moves downward forcing flow in the reverse direction. This completes the cycle.

It has been found that in two hand-operated demonstration models using reciprocating configurations that a temperature span of about 25° F. to 40° F. is possible. This span is two to three times the adiabatic temperature span of the rubber due to its change in stretch in the device. These models had significant heat leaks, but it is estimated that a temperature span of ten times the adiabatic temperature is possible.

Figure 8:
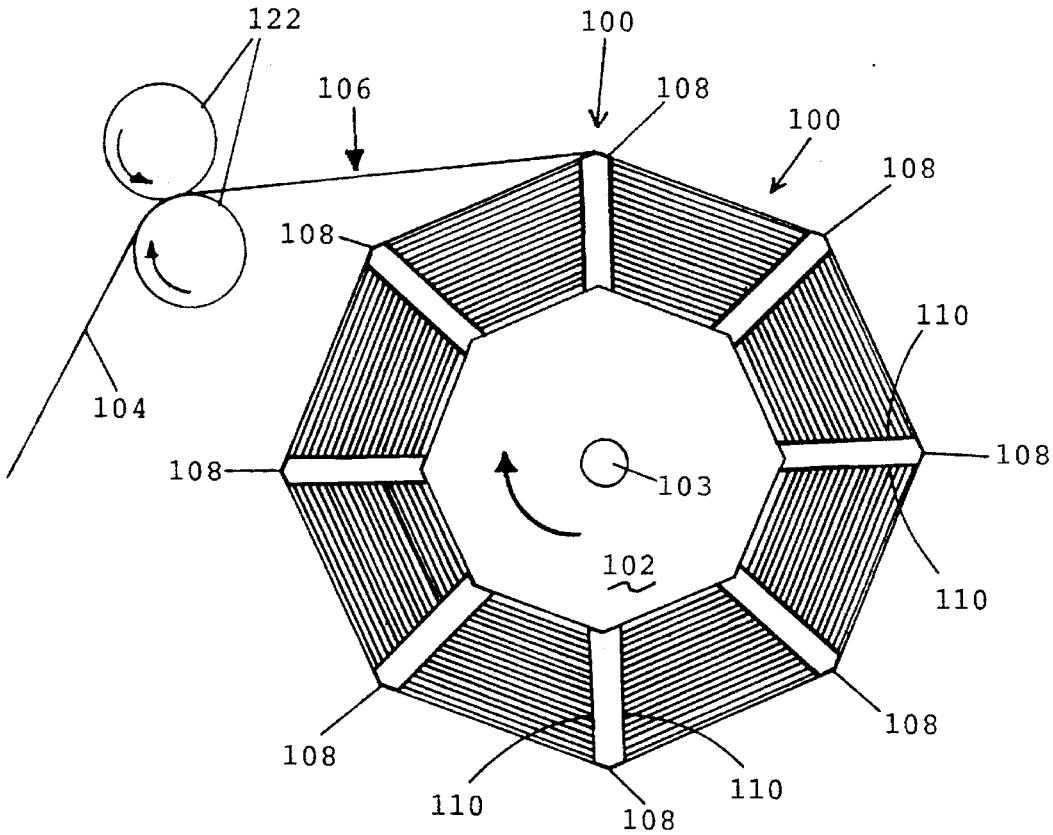
FIG. 8 is a spiral wound elastomer regenerator during winding.
Figure 9:
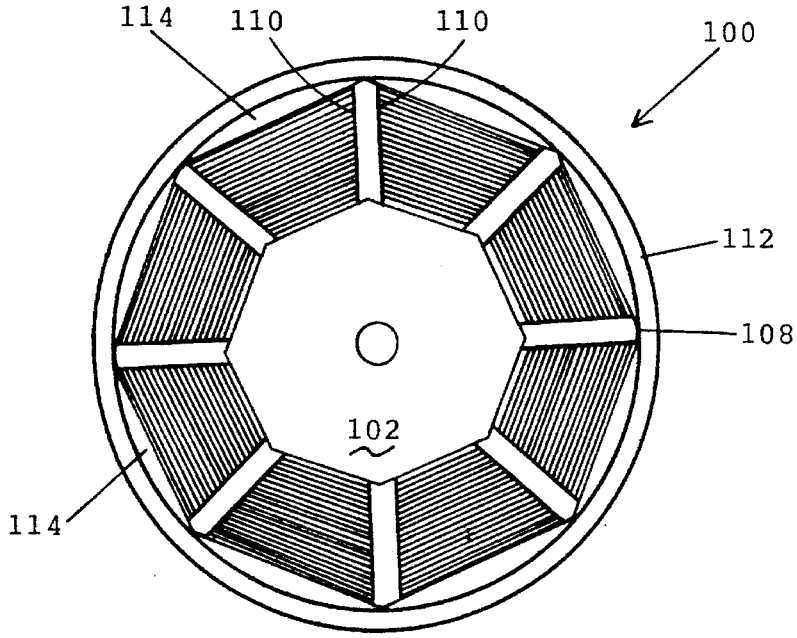
FIG. 9 is a spiral wound elastomer regenerator after an outer rim has been added.

FIGS. 8 and 9 illustrate a method of manufacture of the spiral wound elastomer regenerator wheel 100 suitable for ventilation application. A core 102 is rotated about a shaft 103 while wheels 122 maintain a constant tension in an elastomer ribbon 104 as it feeds. The ribbon 102 in tension is shown by reference numeral 106. Spacers 110 are added at a specific location along ribbon 104. The spacers 110 are thus disposed at uniformly spaced angular positions 108 of the core 100. If glue is added to both sides of the spacer 110 prior to contact with the elastomer ribbon 104, the spiral wound wheel 100 will not unravel when the rubber ribbon 104 is cut. A cylindrical rim 112 is placed around the wheel 100 after the winding process, as best seen in FIG. 9. The gaps 114 between the rim and the outermost surface of the spiral are filled or covered so as to prevent flow through them.

In using the bed of the present invention in any of its applications, frequent cleaning is often important to maintain the high performance of a regenerator. Cleaning of the present invention can be readily effected. Cleaning threads can be inserted in each space between the elastomer sheets, one thread per space. Each thread extends along the flow direction the entire length of the channel with excess extending beyond the channel on either side. The threads can be grasped by the excess, in groups, and the channels can be "flossed" clean. The threads can remain in the channels during use, placed on either side, up against a spacer. The flow will be essentially unobstructed in this position. The inventor is unaware on any other regenerator design that can utilize such a cleaning method.

Having described the invention in general, the following are specific examples of the present invention. The examples are to be construed as merely illustrative, and not limitative of the remainder of the disclosure in any way whatsoever.

EXAMPLE 1

An elastomer bed of the following dimensions was built.

| | |
|---|---|
| Elastomer unstretched thickness | 0.006 inch |
| Shim thickness | 0.006 inch |
| Bed height | 1.6 inches variable |
| Bed width | 1.25 inches |
| Bed length | 2.75 inches |
| Bed porosity (pore volume/total volume) | 0.86 |

After stretching, the channels were 0.01 in. wide and extend 1.6 in. and 2.75 in. in the two directions. The channels are unobstructed in any way. There are approximately 100 channels in the bed.

The bed was made with commercially available latex and rubber sheeting. Clear plastic film was used for the spacers or shims. Superglue™ was used to adhere the spacers; standard wood and hardware were used for the blocks and rods.

The channels in the elastomer regenerator were essentially rectangular in shape. The aspect ratio for a channel with a width of 1.6 in. and a height of 0.01 in. is 160, which provides virtually the same performance as infinite parallel channels.

It is noted that prior art regenerator wheels, for room temperature ventilation, often use many layers of fine aluminum wire mesh stacked in the direction of flow. Pressure drop can be relatively high for this type of matrix. The use of corrugated foil, stacked perpendicular to the direction of flow, has alleviated the pressure drop problems, and results in a structure resembling a small pore honeycomb. The channels, however, resemble rounded triangles. The parallel channels of the bed of the present invention have a significantly better heat transfer to pressure drop ratio than such corrugated face structures.

EXAMPLE 2

An elastomer regenerator similar to the one in Example 1 was built. In this case, the sheet spacing was 0.6 mm and the channel length was 12 cm. A porosity of 0.98 was achieved. The matrix in accordance with the present invention can have significantly higher porosity than the existing technologies. This can be an advantage if the matrix material has a high heat capacity per unit volume. Rubber has such a high heat capacity per unit volume.

EXAMPLE 3

A dual regenerator configuration similar to that shown in FIG. 6 was built and tested as a passive regenerator. The regenerators modules were fabricated with 0.006 in. thick latex sheets separated by 0.006 in. thick spacers made from clear plastic transparency film. The spacers were glued to the latex sheets with Superglue™. The width of the regenerators perpendicular to the sheets was approximately 1.25 in. The height was 1.6 in. in the stretch direction and the length was approximately 2.75 in. Prior to stretching, the height was 0.5 in. An electrical heater and thermocouple thermometer were placed between the two regenerators. Rigid foam insulation was used to insulate the sides of the regenerators and the space between. Applying 1.8 W of heat elevated the temperature between regenerators from 69.5° F. to 122.5° F. when approximately 3 liters of air were shuttled through the system with a 1.5 second period between flow reversal. If no regenerators were in place, approximately 70 W of heat would be required to maintain the same temperature difference. The effectiveness of the regenerators was, consequently, approximately 68.2 W/70 W=0.97. While this effectiveness has considerable variance, it demonstrates that the rubber regenerators can have excellent effectiveness. No measurement was made of the pressure drop across each regenerator during flow.

In summary, the present invention provides an elastomer bed which can be used with passive or active regenerator applications. The bed in accordance with the present invention has a very fine parallel plate structure in which the sheets and the sheet separation can be of the order of the thickness of ordinary paper. The bed has excellent heat transfer properties. The very low thermal conductivity of elastomers is advantageous over, e.g., aluminum foil regenerators, reducing conduction of heat from the hot to the cold side of the regenerator and increasing effectiveness. Contact, except with very sharp objects, will not damage the bed. (A corrugated aluminum foil bed, on the other hand, is easily damaged.)

Compact and lightweight designs are possible since flow channel dimensions can be made smaller than any competing technology. These compact designs can be employed as passive regenerators in Stirling refrigerators and other regenerative gas cycle refrigerators, as long as the cold temperature does not go below the glass transition temperature of the elastomer, or above the temperature around which the elastomer is damaged by heat.

Finally, it is noted that the bed of the invention can be fabricated as an enthalpy exchanger. For example, rubber can be treated to become tacky such as is done with bicycle patch kits that use a solvent to make the rubber "tacky." Desiccant particles similar to those described in the Steele et al. patent, noted hereinbefore, may simply be sprinkled prior to the rubber's final vulcanization. Other methods are also possible to cause desiccant particles to adhere to the rubber's surface.

While the present invention has now been described and exemplified with some specificity, those skilled in the art will appreciate the various modifications, including variations, additions, and omissions, that may be made in what has been described. Accordingly, it is intended that these modifications also be encompassed by the present invention and that the scope of the present invention be limited solely by the broadest interpretation that lawfully can be accorded the appended claims.

I claim:

1. A method of refrigeration of the type employing a elastomeric element, a regenerator and a single-phase heat transfer fluid at temperatures $T_C$ and $T_H$, respectively, the method comprising:

(a) stretching the elastomeric element to increase the average temperature of the element by $\Delta T$;

(b) flowing the fluid at a temperature substantially $T_C$ through the element so that the fluid flows out of the element at about $T_H + \Delta T$, (c) contracting the element to decrease the average temperature of the element by $\Delta T$, (d) flowing the fluid through the element in the reverse direction at $T_H$ so that the fluid flows out of the element at about $T_C - \Delta T$, and (e) transferring heat from the emerging fluid during steps (b) and transferring heat to the emerging fluid during step (d) to objects to be temperature affected thereby.

2. A method of refrigeration of the type employing a elastomeric element, a regenerator and a single-phase heat transfer fluid at temperatures $T_C$ and $T_H$, respectively, the method comprising:

(a) stretching the elastomeric element to increase the average temperature of the element by $\Delta T$;

(b) flowing the fluid at a temperature substantially $T_C$ through the element so that the fluid flows out of the element at about $T_H + \Delta T$;

(c) contracting the element to decrease the average temperature of the element by $\Delta T$;

(d) flowing the fluid through the element in the reverse direction at $T_H$ so that the fluid flows out of the element at about $T_C - \Delta T$; and.

(e) transferring heat from the emerging fluid during steps (b) and transferring heat to the emerging fluid during step (d) to objects to be temperature affected thereby, wherein said elastomeric element comprises (i) parallel layers of stretched thermoelastic sheets, each said layer being generally rectangular and having a layer length dimension, each said sheet having an unstretched sheet length less than said layer length dimension; (ii) spacers between said sheets defining substantially parallel fluid flow channels therebetween, each said channel having a first rectangular face adjacent a first layer and a second rectangular face adjacent a second opposite layer; (iii) locking means for locking said sheets and spacers together;

wherein step (b) includes directing said fluid through said flow channels and over said sheets, said fluid having a first temperature when incident upon said flow channels and sheets, and a second temperature upon exiting from said flow channels; and wherein step (c) includes changing in stretch said sheets between a higher state of stretch and a lower state of stretch whereby said fluid first temperature is changed to said second temperature by forcing said fluid over said sheets.

3. A refrigeration apparatus, comprising:

(a) a porous matrix including an elastomer element;

(b) means for changing the temperature of said porous matrix by stretching or contracting said elastomer element;

(c) a circulator for passing a heat transfer fluid through said porous matrix in a first direction when said porous matrix is at one temperature and in a reverse direction through said porous matrix when said porous matrix is at another temperature; and (d) heat exchanger means for receiving said fluid from both directions from said porous matrix and for circulating the fluid through an object to be temperature affected thereby.

4. The apparatus of claim 3, wherein said elastomer element comprises (i) parallel layers of stretched thermoelastic sheets, each said layer being generally rectangular and having a layer length dimension, each said sheet having an unstretched sheet length less than said layer length dimension; (ii) spacers between said sheets defining substantially parallel fluid flow channels therebetween, each said channel having a first rectangular face adjacent a first layer and a second rectangular face adjacent a second opposite layer; and (iii) locking means for locking said sheets and spacers together;

wherein said fluid is directable through said flow channels and over said sheets, said fluid having a first temperature when incident upon said flow channels and sheets, and a second temperature upon exiting from said flow channels; and wherein said sheets exhibit a change in stretch between a state of higher stretch and a state of lower stretch and said fluid first temperature is changed to said second temperature by forcing said fluid over said sheets.

5. The apparatus of claim 4, wherein a plurality of said porous are disposed radially about a wheel hub forming a wheel.

6. The apparatus of claim 4, wherein each said layer is rectangular.

7. The apparatus of claim 4, wherein each said layer is trapezoidal.

8. The apparatus of claim 5, wherein said wheel includes eccentricity means for stretching and contracting the elements of said porous.

9. The apparatus of claim 5, wherein said heat exchanger means includes a hot heat exchanger proximate one side of said wheel and a cold heat exchanger proximate the other side of said wheel.

10. A refrigeration apparatus, comprising: a reciprocating elastomer bed, a reciprocating bed drive, a circulator and a heat exchanger;

said reciprocating elastomer bed including a first and a second elastomeric element, each said elastomeric element including (i) parallel layers of stretched thermoelastic sheets, (ii) spacers between said sheets defining substantially parallel fluid flow channels therebetween, (iii) locking means for locking said sheets and spacers together, and (iv) a heat transfer fluid directable through said flow channels and over said sheets; each said layer being generally rectangular and having a layer length dimension; said sheets changeable in stretch between a state of higher stretch and a state of lower stretch, each said sheet having an unstretched sheet length less than said layer length dimension; each said channel having a first rectangular face adjacent a first layer and a second rectangular face adjacent a second opposite layer; said heat transfer fluid having a first temperature when incident upon said flow channels and sheets, and a second temperature upon exiting from said flow channels; said first elastomeric element having a common locking means between said first elastomeric element and said second elastomeric element, and said first and second elastomeric elements each having a noncommon locking means;

said reciprocating bed drive attached to said noncommon locking means of said first elastomeric element and to said noncommon locking means of said second elastomeric element, and reciprocatable in a first direction to stretch said first elastomeric element and to relax said second elastomeric element and in an opposite direction to relax said first elastomeric element and to stretch said second elastomeric element, each elastomeric element being cooled as it is relaxed and warmed as it is stretched;

said circulator for passing a heat transfer fluid through said bed in a first direction when said bed is at one temperature and in an opposite direction through said bed when said bed is at a different temperature;

said heat exchanger means for receiving said fluid from both directions from said bed and for circulating the fluid through an object to be temperature affected thereby.

11. The apparatus of claim 10 wherein a said relaxing and stretching of said first and second elastomeric elements creates a temperature span of about two to three times an adiabatic temperature span of a sheet material of said thermoelastic sheets.

12. The apparatus of claim 11 wherein said sheet material is rubber.

13. The apparatus of claim 10 wherein said relaxing and stretching of said first and second elastometric elements creates a temperature span of at least 10 times an adiabatic temperature span of a sheet material of said thermoelastic sheets.

14. A method of pumping heat of the type employing a elastomeric element and a single-phase heat transfer fluid at temperatures $T_C$ and $T_H$, respectively, the method comprising:

(a) stretching the elastomeric element to increase the average temperature of the element by $\Delta T$;

(b) flowing the fluid at a temperature substantially $T_C$ through the element so that the fluid flows out of the element at about $T_H+\Delta T$;

(c) contracting the element to decrease the average temperature of the element by $\Delta T$; and (d) flowing the fluid through the element in the reverse direction at $T_H$ so that the fluid flows out of the element at about $T_C-\Delta T$;

wherein said elastomeric element comprises (i) parallel layers of stretched thermoelastic sheets, each said layer being generally rectangular and having a layer length dimension, each said sheet having an unstretched sheet length less than said layer length dimension; (ii) spacers between said sheets defining substantially parallel fluid flow channels therebetween, each said channel having a first rectangular face adjacent a first layer and a second rectangular face adjacent a second opposite layer; (iii) locking means for locking said sheets and spacers together;

wherein step (b) includes directing said fluid through said flow channels and over said sheets, said fluid having a first temperature when incident upon said flow channels and sheets, and a second temperature upon exiting from said flow channels; and wherein step (c) includes changing in stretch said sheets between a higher state of stretch and a lower state of stretch whereby said fluid first temperature is changed to said second temperature by forcing said fluid over said sheets.

15. A heat pump apparatus, comprising:

(a) a porous matrix including an elastomer element;

(b) means for changing the temperature of said porous matrix by stretching or contracting said elastomer element;

(c) a circulator for passing a heat transfer fluid through said porous matrix in a first direction when said porous matrix is at one temperature and in a reverse direction through said porous matrix when said porous matrix is at another temperature;

wherein said elastomer element comprises (i) parallel layers of stretched thermoelastic sheets, each said layer being generally rectangular and having a layer length dimension, each said sheet having an unstretched sheet length less than said layer length dimension; (ii) spacers between said sheets defining substantially parallel fluid flow channels therebetween, each said channel having a first rectangular face adjacent a first layer and a second rectangular face adjacent a second opposite layer; and (iii) locking means for locking said sheets and spacers together;

wherein said fluid is directable through said flow channels and over said sheets, said fluid having a first temperature when incident upon said flow channels and sheets, and a second temperature upon exiting from said flow channels; and wherein said sheets exhibit a change in stretch between a state of higher stretch and a state of lower stretch and said fluid first temperature is changed to said second temperature by forcing said fluid over said sheets.

16. The apparatus of claim 15, wherein a plurality of said porous matrices are disposed radially about a wheel hub forming a wheel.

17. The apparatus of claim 15, wherein each said layer is rectangular.

18. The apparatus of claim 16, wherein said wheel includes eccentricity means for stretching and contracting the elements of said porous matrices.

* * * * *

Disclaimer 5,465,781—Anthony J. DeGregoria, Madison, Wis. ELASTOMER BED. Patent dated Nov. 14, 1995. Disclaimer filed May 19, 1997, by the assignee, ElasTek, Inc.

Hereby enters this disclaimer to claim 7 of said patent.

*(Official Gazette,* August 12, 1997)

UNITED STATES PATENT AND TRADEMARK OFFICE

CERTIFICATE OF CORRECTION

PATENT NO. : 5,465,781

DATED : November 14, 1995

INVENTOR(S) : Anthony J. DeGregoria

It is certified that error appears in the above-indentified patent and that said Letters Patent is hereby corrected as shown below:

In column 12, line 25, after the word "porous" and before the word "are", insert therein --matrices--.

In column 12, line 33, after the word "porous" and before the period, insert therein --matrices--.

Signed and Sealed this

Twenty-first Day of October 1997

*Attest:*

*Attesting Officer*

BRUCE LEHMAN

*Commissioner of Patents and Trademarks*